United States Patent [19]

Huenniger et al.

[11] Patent Number: 4,570,455

[45] Date of Patent: Feb. 18, 1986

[54] CONDENSER PURGE PROBE

[75] Inventors: Edward A. Huenniger, Liverpool; Edson Byrns, Fayetteville, both of N.Y.

[73] Assignee: Carrier Corporation, Syracuse, N.Y.

[21] Appl. No.: 688,787

[22] Filed: Jan. 4, 1985

[51] Int. Cl.[4] ..... F25B 43/04

[52] U.S. Cl. ..... 62/475

[58] Field of Search ..... 62/85, 195, 475

[56] References Cited

FOREIGN PATENT DOCUMENTS 381412 7/1932 United Kingdom ..... 62/475

390713 4/1933 United Kingdom ..... 62/475

*Primary Examiner*—Lloyd L. King

*Attorney, Agent, or Firm*—Douglas L. Miller

[57] ABSTRACT

A condenser purge probe is provided for use with a condenser enclosing a plurality of condenser tubes, wherein the purge probe has a wave-like form comprising a plurality of alternating wave segments having exterior configurations approximating portions of the exterior configurations of the condenser tubes. The purge probe is selectively positionable in conforming and interlocking relationship with selected ones of the condenser tubes, thereby permitting selective placement of the purge probe in the condenser and substantially reducing vibration of the probe during operation of the condenser.

11 Claims, 5 Drawing Figures

CONDENSER PURGE PROBE

BACKGROUND OF THE INVENTION

This invention pertains to a purge system in a refrigeration system, and more particularly to a purge probe for withdrawing noncondensible gases and other contaminants from a condenser.

Within refrigeration systems, various noncondensible gases and other contaminants normally become mixed with refrigerant and tend to collect at some point in the refrigeration system. In those refrigeration systems wherein the evaporator operates under a partial vacuum, noncondensible gases and other contaminants tend to concentrate generally at the central portion of the condenser. The presence of noncondensible gases and other contaminants in the refrigeration system reduces the efficiency thereof. For example, when noncondensible gases and refrigerant vapor mix in the condenser, this gaseous mixture blankets the condenser tubes and thus reduces the transfer of heat thereto. Further, the capacity of the refrigeration system is reduced since the noncondensible gases displace refrigerant vapor flowing through the refrigeration system.

Various schemes have been previously utilized to remove noncondensible gases and other contaminants concentrating within the condenser and about the condenser tubes. For example, in some condensers, divider plates are inserted into the condenser to separate the condenser tubes into sections of differently directed flow paths for the cooling fluid, such as water. Because of the insertion of the divider plates, some of the condenser tubes are spaced further apart than normal and it is within this spaced apart area that purge probes have been positioned to withdraw noncondensible gases and other contaminants. One of the problems with this arrangement is that the fluid flow is generally greater in the separated areas and thus do not provide a true or optimum sampling or withdrawal of contaminants.

Another earlier arrangement for positioning a purge probe is to insert the probe just inside the inner peripheral surface of the condenser shell. This is an undesirable location since the noncondensible gases and other contaminants tend to concentrate generally at the center of the condenser.

SUMMARY OF THE INVENTION

Therefore, it is an object of the present invention to provide an improved purge probe for a condenser.

Another object of the present invention is to provide a purge probe for a condenser that increases the transfer of heat therein.

Yet another object of the present invention is to provide a purge probe for a condenser wherein the probe can easily be positioned at the center of the condenser tubes.

A further object of the present invention is to provide a purge probe for a condenser that can be positioned in the area of maximum concentration of noncondensible gases and other contaminants in an efficient and economical manner.

A still further object of the present invention is to provide a purge probe for a condenser that can be selectively positioned therein.

Yet still a further object of the present invention is to provide a purge probe for a condenser having a configuration that substantially eliminates vibration of the purge probe during operation of the condenser.

In one form of the present invention, there is provided a purge probe adapted for use with a condenser enclosing a plurality of condenser tube members, wherein the purge probe comprises a hollow main body having an inlet adapted to be positioned inside the condenser and an outlet to lead from the condenser. The main body of the purge probe includes a portion thereof having a wave-like form comprising a plurality of alternating wave segments having exterior configurations adapted to approximate portions of the exterior configurations of the condenser tube members. The main body portion is adapted to be disposed in conforming and interlocking relationship between selected ones of the condenser tube members.

BRIEF DESCRIPTION OF THE DRAWINGS

The above-mentioned and other features and objects of the present invention, and the manner of attaining them, will become more apparent and the invention itself will be better understood by reference to the following description of an embodiment of the invention taken in conjunction with the accompanying drawings, wherein.

DESCRIPTION OF A PREFERRED EMBODIMENT

Figure 1:
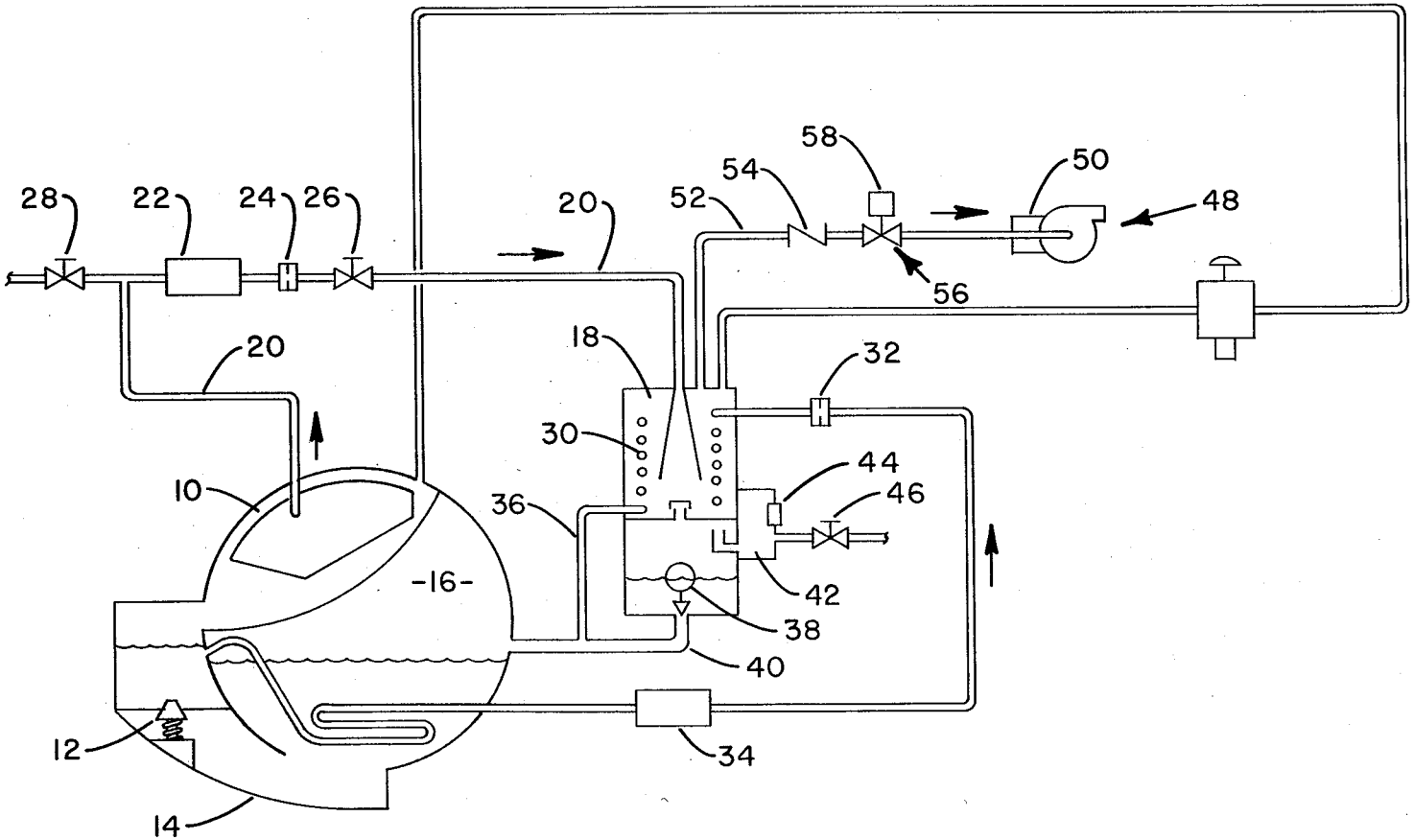
FIG. 1 is a schematic illustration of a refrigeration system in which a purge probe may be operated according to the principles of the present invention.

Referring to FIG. 1, there is a schematic refrigeration system which may incorporate a purge probe according to the principles of the present invention. The refrigeration system in FIG. 1 is a typical vapor compression refrigeration system wherein refrigerant is compressed by a compressor (not shown) and discharged into a condenser 10. Condenser 10 discharges liquid refrigerant to expansion device 12, such as a poppet valve, float valve, or simple orifice, that delivers liquid and vaporized refrigerant through conduit 14 to evaporator 16. Liquid refrigerant in evaporator 16 is evaporated to cool a heat transfer fluid, such as water, flowing through heat transfer tubing (not shown) in evaporator 16. Evaporated refrigerant from evaporator 16 is then discharged through a discharge line (not shown) to the suction side of the compressor where the refrigerant begins another refrigeration cycle.

Various noncondensible gases and other contaminants may become mixed with the refrigerant and concentrate within condenser 10, particularly at a center portion thereof. To purge the refrigeration system without losing refrigerant, it is necessary to separate noncondensible gases and other contaminating matter from the refrigerant. Accordingly, purge chamber 18 is provided for this purpose and is connected to condenser 10 by conduit 20 for extracting a gaseous mixture from condenser 10 and delivering it to purge chamber 18. This gaseous mixture entering purge chamber 18 will normally be a mixture of noncondensible gases, refrigerant vapor, and water vapor.

Conduit 20 has a strainer 22 for removing any particulate contaminating matter which may be entrained in the gaseous mixture from condenser 10. Conduit 20 further includes orifice 24 to regulate the flow of vapor between condenser 10 and purge chamber 18. A normally open valve 26 is coupled with conduit 20 and may be manually operated to isolate the purge system from the refrigeration system under certain circumstances, such as when the refrigeration system is pressurized through valve 28 for leak testing the refrigeration system. It should be noted that valve 28 is closed during normal operation of the purge and refrigeration systems. Also, purge chamber 18 operates at a lower pressure than condenser 10.

Condensing coil 30 is located in the top portion of purge chamber 18 to receive cool fluid used to condense the refrigerant vapor which is provided to purge chamber 18. Condensing coil 30 receives the cool fluid from condenser 10. Orifice 32 is provided in the inlet line to condensing coil 30 to reduce refrigerant pressure when liquid refrigerant is supplied from condenser 10 to condensing coil 30. Filter 34 is also provided to remove any particulate contaminating matter which may be in the refrigerant flowing from condenser 10 to condensing coil 30. Refrigerant from condensing coil 30 is returned to evaporator 16 through refrigerant outlet line 36.

The cool fluid circulating through condensing coil 30 in purge chamber 18 lowers the temperature of the gaseous mixture of refrigerant, noncondensible gases, and other contaminating material collected in purge chamber 18 to condense the refrigerant vapor and other condensibles, such as water vapor. The less dense condensibles such as water collect as a layer on top of the relatively pure liquid refrigerant condensed in purge chamber 18. Within purge chamber 18 is float valve 38 to control the level of liquid refrigerant in purge chamber 18. As the liquid level rises in purge chamber 18, float valve 38 automatically opens to discharge substantially pure liquid refrigerant from purge chamber 18 to evaporator 16 through line 40, and as the liquid level in purge chamber 18 drops to a predetermined level float valve 38 closes. An intermediate chamber 42 is provided for separating condensed water from condensed refrigerant. Liquid refrigerant from intermediate chamber 42 is allowed to pass to the bottom portion of purge chamber 18 where float valve 38 is located. Water, being of a lower density than refrigerant, is then trapped in the upper part of intermediate chamber 42. A side wall of intermediate chamber 42 is provided with sight glass 44 which permits one to determine by visual observation the level of water within intermediate chamber 42. Manual valve 46 is also arranged on the side wall of intermediate chamber 42 to drain off the accumulated water.

The noncondensible gases, such as air, collect in the upper part of purge chamber 18. As the noncondensible gases accumulate, the pressure in purge chamber 18 rises approaching the pressure of condenser 10. In order to expel the noncondensible gases, purge pump 48, which is driven by electric motor 50, is connected with purge chamber 18 by line 52. Line 52 includes check valve 54 and solenoid operated valve 56 with solenoid coil 58 for controlling the flow of noncondensible gases to purge pump 48.

Although the above refrigeration system has been described as one in which the purge probe of the present invention may be operated, it is understood that the present invention contemplates the purge probe to be useable with other types of refrigeration systems, and particularly with other types of condensers and like devices or apparatuses.

Referring now to FIGS. 2–5, condenser 10 can be of the type comprising condenser shell 60 enclosing therein a plurality of condenser tubes 62. Each condenser tube 62 is configured generally cylindrical with a predetermined radius $R_1$, for example a radius of $\frac{3}{8}$ inch. Condenser tubes 62 are also spaced-apart within condenser shell 60 a predetermined distance, for example $\frac{1}{8}$ inch.

Figure 4:
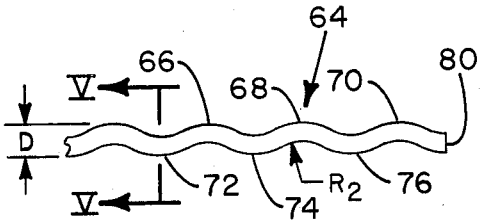
FIG. 4 is a side elevational view of the embodiment in FIG. 3.

Purge probe 64 representing one embodiment of the present invention is generally flexible, elongate, and of hollow wave-like form. Purge probe 64 can be made from an easily worked metal, such as copper, copper-nickel alloy, brass, and aluminum or a moldable plastic material, and comprises a plurality of alternating wave segments, such as wave segments 66, 68, 70, 72, 74, 76 (FIG. 4). Each wave segment 66–76 is of arcuate configuration having a wave radius $R_2$ approximating condenser tube radius $R_1$, for example $R_2$ being $\frac{3}{8}$ inch. The maximum transverse dimension D (FIG. 4) is dependent upon the radius and spacing of condenser tubes 62 and in this example wherein $R_1$ and $R_2$ are $\frac{3}{8}$ and the spacing between tubes 62 is $\frac{1}{8}$ inch, maximum transverse dimension D is between about $\frac{3}{8}$ inch to $\frac{1}{2}$ inch.

Figure 5:
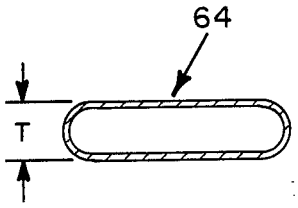
FIG. 5 is a cross-sectional view of FIG. 4 taken along line V—V and viewed in the direction of the arrows.

Referring to FIG. 5, purge probe 64 has a thickness T that is a function of the spacing between condenser tubes 62, and in this embodiment wherein tubes 62 are spaced apart $\frac{1}{8}$ inch, probe thickness T is approximately $\frac{1}{8}$ inch.

Insertion of purge probe 64 in condenser 10 is easily accomplished by providing condenser 10 with a hole 78 in condenser shell 60 and inserting a rod or other similar tool through hole 78 to separate condenser tubes 62 for subsequent insertion of purge probe 64. The maximum transverse dimension of the rod (not shown) is determined by the maximum transverse dimension D of purge probe 64, and in the given example wherein the maximum transverse dimension D of probe 64 is approximately $\frac{3}{8}$ inch to $\frac{1}{2}$ inch, the maximum transverse dimension of the rod would be $\frac{3}{8}$ inch to $\frac{1}{2}$ inch. Once purge probe 64 has been inserted to the desired depth and position in condenser shell 60, the rod is removed for subsequent sealing of condenser hole 78.

Figure 2:
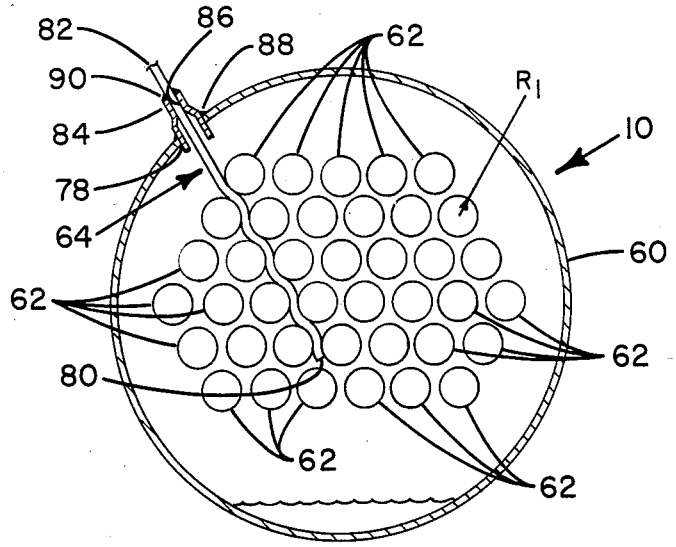
FIG. 2 is a transverse cross-sectional view of a condenser incorporating a preferred embodiment of the present invention.
Figure 3:
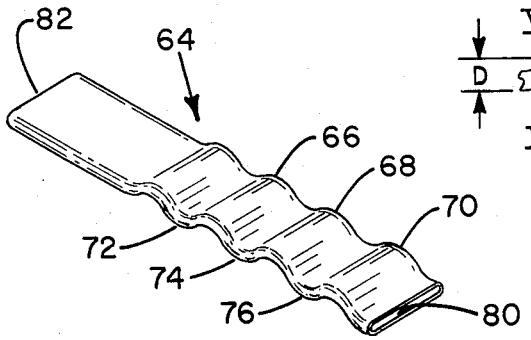
FIG. 3 is a perspective view of the embodiment of the present invention in FIG. 2.

According to the principles of the present invention, it is preferred that inlet 80 of purge probe 64 be positioned at the center of the bundle of condenser tubes 62, as illustrated in FIG. 2, and that inlet 80 face in a generally downward direction to prevent any liquid matter from entering therein. Outlet 82 of purge probe 64 is connected to conduit 20 in any suitable manner. Prior to connecting outlet 82 to conduit 20, fitting 84, which may be made of a steel material, and having opening 86 therein for receiving purge probe 64 therethrough is tightly fitted in condenser hole 78, as illustrated in FIG. 2. Fitting 84 is then securely sealed in hole 78 by welding at their juncture 88, and probe 64 is securely sealed in opening 86 by brazing at juncture 90.

As illustrated in FIG. 2, it is apparent that the wave-like form of purge probe 64 along with its predetermined wave-radius $R_2$, maximum transverse dimension D, and thickness T is conformingly and interlockingly held between arcuate portions of adjacent condenser tubes 62. Since the wave radius $R_2$ and condenser tube radius $R_1$ are substantially the same, and because of the racetrack-like cross section (FIG. 5) of purge probe 64, probe 64 is prevented from being undesirably displaced from its desired position, and experiences very little, if any, vibration during operation of condenser 10.

While this invention has been described as having a preferred embodiment, it will be understood that it is capable of further modifications. This application is therefore intended to cover any variations, uses, or adaptations of the invention following the general principles thereof, and including such departures from the present disclosure as come within known or customary practice in the art to which this invention pertains and fall within the limits of the appended claims.

What is claimed is:

1. In a refrigeration system including an evaporator, a condenser enclosing a plurality of condenser tube members, and a purge system including a purge tank for removing noncondensible gases and other contaminants from the refrigeration system; a condenser purge probe for withdrawing noncondensible gases and other contaminants from the condenser, comprising:

an elongate flexible main body having an inlet disposed in said condenser and an outlet connected to said purge tank, said elongate flexible main body including a portion thereof having a wave-like form comprising a plurality of alternating wave segments having exterior configurations approximating portions of the exterior configurations of said condenser tube members, said main body portion being selectively positionable in conforming and interlocking relationship with selected ones of said condenser tube members, thereby permitting selective placement of said main body inlet within said condenser and substantially reducing vibration of said main body during operation of said condenser.

2. The refrigeration system of claim 1 wherein said main body inlet is disposed in a central portion of said plurality of condenser tube members.

3. The refrigeration system of claim 1 wherein said main body inlet faces generally downwardly in said condenser to substantially prevent any liquid matter from entering therein.

4. The refrigeration system of claim 1 wherein said condenser tube members are configured generally cylindrical with predetermined radii, and said wave segments are configured with respective wave radii approximating said predetermined radii of said condenser tube members.

5. The refrigeration system of claim 1 wherein said main body portion has a transverse cross-section of noncircular shape.

6. The refrigeration system of claim 1 wherein said purge tank operates at a pressure less than the pressure in said condenser to provide suction at said inlet of said main body.

7. In a condenser enclosing a plurality of condenser tube members, a purge probe for having withdrawn therethrogh noncondensible gases and other contaminating matter from said condenser, said purge probe, comprising:

a hollow main body having an inlet positioned inside said condenser and an outlet leading from said condenser, said main body including a portion thereof having a wave-like form comprising a plurality of alternating wave segments having exterior configurations approximating portions of the exterior configurations of said condenser tube members, said main body portions being positionable in conforming and interlocking relationship with selected ones of said condenser tube members, thereby permitting selective placement of said main body inlet within said condenser and substantially reducing vibration of said main body.

8. The purge probe of claim 7 wherein said condenser tube members are configured generally cylindrical with predetermined radii, and said wave segments are configured with respective wave radii approximating said predetermined radii of said condenser tube members.

9. The purge probe of claim 8 wherein said main body portion has a transverse cross-section of noncircular shape.

10. The purge probe of claim 9 wherein said main body inlet faces generally downwardly in said condenser.

11. The purge probe of claim 7 wherein said main body inlet is disposed in a central portion of said condenser tube members.

* * * * *